US011673756B2

(12) United States Patent
Itoh

(10) Patent No.: US 11,673,756 B2
(45) Date of Patent: Jun. 13, 2023

(54) IMAGE FORMING APPARATUS AND SHEET CONVEYANCE APPARATUS

(71) Applicant: CANON KABUSHIKI KAISHA, Tokyo (JP)

(72) Inventor: Masatoshi Itoh, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 406 days.

(21) Appl. No.: 16/876,578

(22) Filed: May 18, 2020

(65) Prior Publication Data

US 2020/0369483 A1 Nov. 26, 2020

(30) Foreign Application Priority Data

May 22, 2019 (JP) ..... JP2019-096258

(51) Int. Cl.
*B65H 7/20* (2006.01)
*G03G 15/00* (2006.01)
*B65H 5/06* (2006.01)

(52) U.S. Cl.
CPC ..... *B65H 7/20* (2013.01); *B65H 5/062* (2013.01); *G03G 15/50* (2013.01); *G03G 15/6529* (2013.01); *B65H 2515/32* (2013.01)

(58) Field of Classification Search
CPC ..... B65H 7/20; B65H 5/062; B65H 2515/32; G03G 15/50; G03G 15/6529
See application file for complete search history.

(56) References Cited

U.S. PATENT DOCUMENTS 5,423,527 A * 6/1995 Tranquilla ..... B65H 5/00 271/259
5,848,784 A * 12/1998 Tranquilla ..... B65H 5/34 271/272
9,893,675 B2 2/2018 Tachibana et al.

FOREIGN PATENT DOCUMENTS

JP H06-075443 A 3/1994
JP 2004-75210 * 3/2004
JP 2007-153606 A 6/2007
JP 2008-287236 A 11/2008
JP 2014-201409 * 10/2014
(Continued)

OTHER PUBLICATIONS

Machine translation of JP2014-201409. (Year: 2014).*
Japanese Office Action dated Feb. 14, 2023, in related Japanese Patent Application No. 2019-096258.

*Primary Examiner* — Thomas A Morrison
(74) *Attorney, Agent, or Firm* — Venable LLP

(57) ABSTRACT

An image forming apparatus includes a conveyance unit to convey a sheet toward an image forming position, a torque detection unit to detect a load torque applied to a motor driving the conveyance unit, and a control unit to perform a speed control for changing a rotational speed of the motor such that an interval at which a preceding sheet and a succeeding sheet pass through the image forming position approaches a target interval while the conveyance unit is conveying the succeeding sheet. The control unit executes an interval change processing for changing the target interval in the speed control based on a magnitude of a detected load torque when the conveyance unit is driven by the motor, the control unit controls power input to the motor by transmitting a command signal to a driving circuit of the motor, and the torque detection unit detects the command signal.

10 Claims, 12 Drawing Sheets

(56) References Cited

FOREIGN PATENT DOCUMENTS

| | | | |
|---|---|---|---|
| JP | 2015-194609 | A | 11/2015 |
| JP | 2016-144260 | A | 8/2016 |
| JP | 2016-199395 | A | 12/2016 |
| JP | 2017-128433 | A | 7/2017 |
| JP | 2018-205535 | A | 12/2018 |

* cited by examiner

FIG.11

| SHEET INTERVAL TABLE | | FEED DELAY AMOUNT | | | | | | | | | |
|---|---|---|---|---|---|---|---|---|---|---|---|
| | | 10mm | 20mm | 30mm | 40mm | 50mm | 60mm | 70mm | 80mm | 90mm | 100mm |
| PWM_AVE | 1.0% | 10 | 10 | 10 | 10 | 10 | 10 | 10 | 10 | 10 | 10 |
| | 20.0% | 10 | 10 | 10 | 10 | 10 | 10 | 10 | 10 | 10 | 10 |
| | 30.0% | 10 | 10 | 10 | 10 | 10 | 10 | 10 | 10 | 10 | 10 |
| | 40.0% | 10 | 10 | 10 | 10 | 10 | 10 | 10 | 10 | 10 | 20 |
| | 50.0% | 10 | 10 | 10 | 10 | 10 | 10 | 10 | 20 | 30 | 40 |
| | 60.0% | 10 | 10 | 10 | 10 | 10 | 20 | 30 | 40 | 50 | 60 |
| | 70.0% | 10 | 10 | 10 | 20 | 30 | 40 | 50 | 60 | 70 | 80 |
| | 80.0% | 10 | 10 | 20 | 30 | 40 | 50 | 60 | 70 | 80 | 90 |
| | 90.0% | 10 | 20 | 30 | 40 | 50 | 60 | 70 | 80 | 90 | 100 |
| | 100.0% | 20 | 30 | 40 | 50 | 60 | 70 | 80 | 90 | 100 | 110 |

IMAGE FORMING APPARATUS AND SHEET CONVEYANCE APPARATUS

BACKGROUND OF THE INVENTION

Field of the Invention

The present invention relates to an image forming apparatus for forming an image on a sheet and a sheet conveyance apparatus for conveying a sheet.

Description of the Related Art

In an image forming apparatus such as a printer, a copying machine, and a multifunction machine, a sheet used as a recording material is fed one by one from a feed cassette or the like, and an image is formed on the sheet by an image forming unit based on an electrophotographic system, an inkjet system, or the like. Inside the image forming apparatus, a sheet is conveyed by a conveyance roller driven by a motor. The conveyance speed of a sheet in the apparatus is not always constant, and may be accelerated or decelerated during the conveyance operation.

JP-A-2008-287236 discloses that, in an electrophotographic apparatus for conveying a fed sheet to a transfer unit without temporarily stopping the conveyance of the fed sheet, alignment between the sheet and an image transferred onto the sheet is performed by accelerating or decelerating the sheet conveyance speed. In this apparatus, a sheet is conveyed to the transfer unit at a constant interval in accordance with the interval of the writing start timing of an electrostatic latent image in the image forming unit, so that the productivity of the image forming apparatus is improved.

However, in order to adjust the sheet interval to a target value up to the transfer unit even in a case where the feeding of a sheet is greatly delayed, there is a case where the target speed when accelerating the conveyance speed should be set to a high value. In addition, depending on the magnitude of sheet conveyance resistance or the abrasion state of a roller member, load torque applied to a motor when changing the rotational speed of the motor may increase. For this reason, as a motor for driving the conveyance roller, a high-output motor capable of performing acceleration with a margin even under the conditions of large load torque has been selected. On the other hand, in a case where the target value of the sheet interval is set to a large value (large target interval), the productivity of the image forming apparatus is reduced even though it is possible to convey a sheet using a low-output motor.

SUMMARY OF THE INVENTION

According to a first aspect of the present invention, an image forming apparatus includes an image forming unit configured to form an image on a sheet at an image forming position, a conveyance unit configured to convey a sheet toward the image forming position, a motor configured to drive the conveyance unit, a torque detection unit configured to detect a load torque applied to the motor, and a control unit configured to perform a speed control for changing a rotational speed of the motor such that an interval at which a preceding sheet and a succeeding sheet pass through the image forming position approaches a target interval while the conveyance unit is performing a conveyance operation for conveying the succeeding sheet, wherein the control unit executes an interval change processing for changing the target interval in the speed control based on a magnitude of a load torque detected by the torque detection unit when the conveyance unit is driven by the motor.

According to a second aspect of the present invention, a sheet conveyance apparatus includes a conveyance unit configured to convey a sheet to a predetermined position, a motor configured to drive the conveyance unit, a torque detection unit configured to detect a load torque applied to the motor, and a control unit configured to perform a speed control for changing a rotational speed of the motor such that an interval at which a preceding sheet and a succeeding sheet pass through the predetermined position approaches a target interval while the conveyance unit is performing a conveyance operation for conveying the succeeding sheet, wherein the control unit executes an interval change processing for changing the target interval in the speed control based on a magnitude of a load torque detected by the torque detection unit when the conveyance unit is driven by the motor.

Further features of the present invention will become apparent from the following description of exemplary embodiments with reference to the attached drawings.

BRIEF DESCRIPTION OF THE DRAWINGS

FIG. 11 is a diagram showing a table of a sheet interval according to the second embodiment.

DESCRIPTION OF THE EMBODIMENTS

Figure 1:
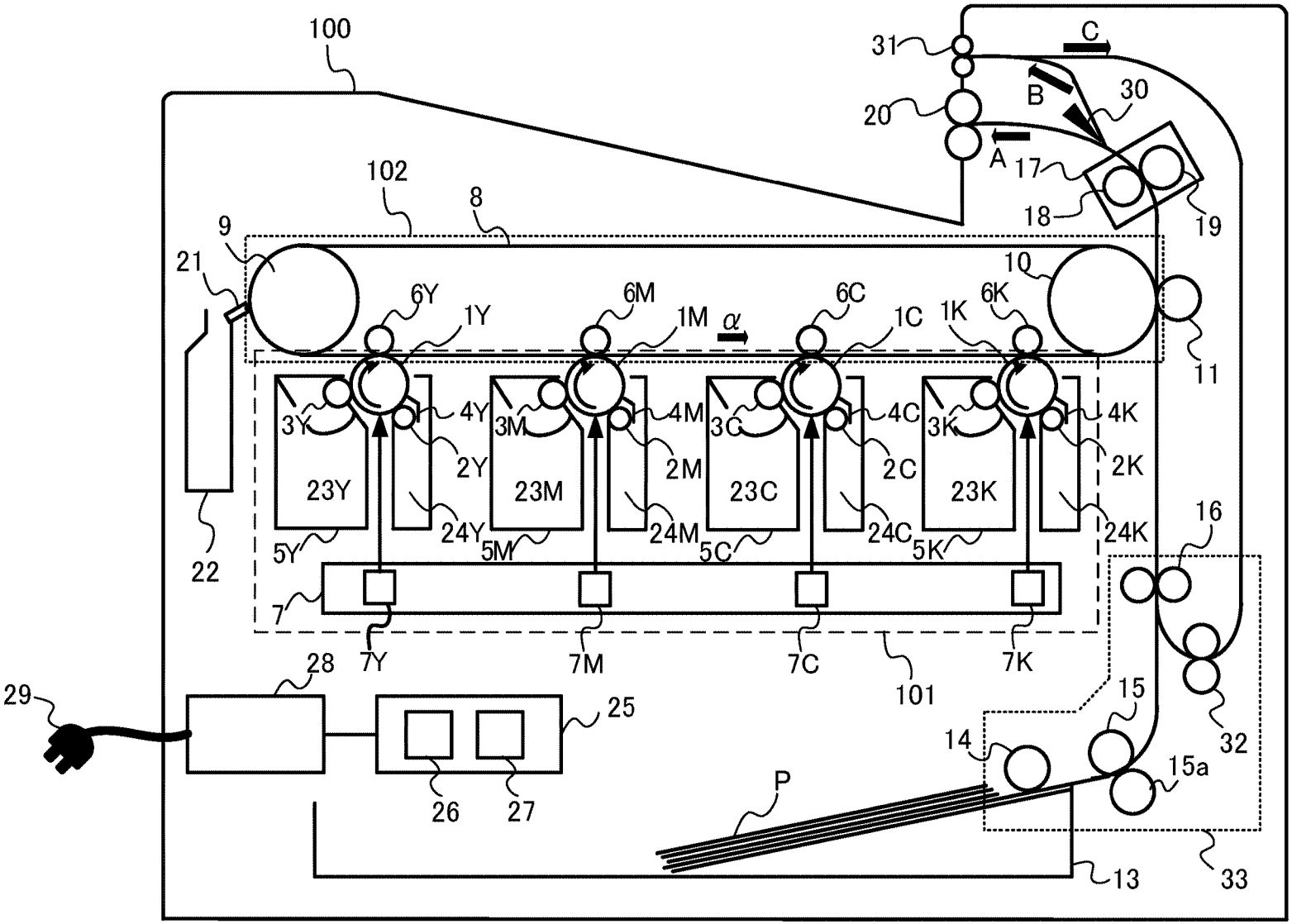
FIG. 1 is a schematic diagram of an image forming apparatus according to a first embodiment.

Hereinafter, exemplary embodiments for carrying out the invention will be described with reference to the accompanying diagrams.

First Embodiment

First, an overall configuration of an image forming apparatus according to a first embodiment will be described. FIG.

1 is a schematic diagram of a printer 100 serving as an image forming apparatus according to the present embodiment. The printer 100 is an image forming apparatus based on an electrophotographic system including an image forming unit 101 including four process cartridges 5Y, 5M, 5C, and 5K detachable from a printer main body and an intermediate transfer unit 102.

The process cartridges 5Y to 5K are different in that yellow (Y), magenta (M), cyan (C), and black (K) toner images are formed, but have the same structure for image formation. Therefore, in the following description, the process cartridge 5Y will be described as an example. The process cartridge 5Y has a toner container 23Y for containing toner, a photosensitive member 1Y, a charge roller 2Y, a developing roller 3Y, a drum cleaner 4Y, and a waste toner container 24Y. An irradiation unit 7Y of an exposing unit 7 is disposed below the process cartridge 5Y.

The photosensitive member 1Y is a rotatable drum-shaped member. When the process cartridge 5Y creates a toner image, the charge roller 2Y uniformly charges the surface of the rotating photosensitive member 1Y so as to have a predetermined polarity and a predetermined potential. The surface of the charged photosensitive member 1Y is exposed by the exposing unit 7, so that an electrostatic latent image corresponding to a yellow color component image is written. The developing roller 3Y rotates while carrying a developer containing toner contained in the toner container 23Y, thereby supplying the toner to the photosensitive member 1Y. As a result, the electrostatic latent image carried on the photosensitive member 1Y is developed to become a toner image. By performing the same process in parallel in the other process cartridges 5M to 5K, toner images of respective colors are formed on the surfaces of the photosensitive members 1Y to 1K.

The intermediate transfer unit 102 includes an intermediate transfer belt 8, a driving roller 9, a secondary transfer opposing roller 10, a belt cleaner 21, and a waste toner container 22. In addition, in the intermediate transfer unit 102, primary transfer rollers 6Y to 6K are provided on the inner side of the intermediate transfer belt 8 so as to face the photosensitive members 1Y to 1K of the process cartridges 5Y to 5K. The driving roller 9 is rotated by a motor (not shown) to rotate the intermediate transfer belt 8 in a direction of arrow a in FIG. 1.

The toner images carried on the photosensitive members 1Y to 1K are primarily transferred onto the intermediate transfer belt 8 in a sequential manner by the primary transfer rollers 6Y to 6K, and are conveyed to a secondary transfer roller 11 in a state in which the toner images of four colors are superimposed. The drum cleaner 4Y as a blade-shaped cleaning member removes attached matter, such as residual toner remaining on the photosensitive member 1Y without being transferred onto the intermediate transfer belt 8, from the surface of the photosensitive member 1Y and collects the attached matter in the waste toner container 24Y.

When the toner images carried on the intermediate transfer belt 8 reach a secondary transfer unit serving as a nip portion formed between the secondary transfer roller 11 and the intermediate transfer belt 8, the toner images are secondarily transferred by the bias electric field formed by the secondary transfer roller 11. The intermediate transfer belt 8 is an image bearing member of the present embodiment, the secondary transfer roller 11 is a transfer member of the present embodiment, and the position of the secondary transfer unit is an image forming position of the present embodiment. The belt cleaner 21 as a blade-shaped cleaning member removes attached matter, such as residual toner remaining on the intermediate transfer belt 8 without being transferred onto the sheet, from the belt surface and collects the attached matter in the waste toner container 22.

In parallel with such an image forming process, a conveyance operation for feeding a sheet P stacked on a feed cassette 13 one by one and conveying the sheet P to the secondary transfer unit is performed. The sheet P stacked on the feed cassette 13 as an example of a sheet stacking unit is fed from the feed cassette 13 by a feed roller 14 in order from the top sheet. A conveyance roller 15 receives the sheet P from the feed roller 14 and conveys the sheet P to a registration roller 16.

A separation roller 15*a* serving as a separation member is connected to a shaft fixed to the printer main body through a torque limiter, so that a separation nip is formed between the separation roller 15*a* and the conveyance roller 15. The separation roller 15*a* applies a frictional force to the sheet P at the separation nip to restrict the passage of sheets other than the top sheet in contact with the conveyance roller 15 through the separation nip. As a result, the sheet P is transferred to the registration roller 16 in a state in which the sheet P is separated one by one. In addition, the separation roller 15*a* is an example of a separation member, and a pad-shaped friction member in contact with the conveyance roller 15 or a retard roller to which a driving force in a direction against the rotation of the conveyance roller 15 (counterclockwise direction in FIG. 1) is input through a torque limiter may be used.

The registration roller 16 conveys the sheet P toward the secondary transfer unit. In the present embodiment, a configuration is adopted in which image alignment in a sheet conveyance direction (sub-scanning direction) is performed by controlling the conveyance speed of the sheet P without stopping the leading edge of the sheet at the registration roller 16.

The sheet P onto which the toner images have been transferred in the secondary transfer unit as described above is conveyed to a fixing unit 17. The fixing unit 17 includes a heating roller 18 and a pressure roller 19 as a pair of rotary members for conveying the sheet P with the sheet P interposed therebetween and a heating element, such as a halogen lamp for heating each toner image on the sheet through the heating roller 18. Each toner image on the sheet is heated and pressed to be melted when passing through the nip portion between the heating roller 18 and the pressure roller 19 and is then fixed, thereby being fixed to the sheet P.

The conveyance path of the sheet P fed from the fixing unit 17 is switched by a flap-shaped switching member 30. The sheet P guided to a conveyance path (A) toward a sheet discharge roller 20 is discharged to the outside of the printer main body by the sheet discharge roller 20, and is stacked on a sheet discharge tray provided on the top surface of the casing of the printer 100. In the case of performing double-sided printing, the sheet P having an image formed on its first surface is guided to a conveyance path (B) toward a reverse conveyance roller 31 by the switching member 30. Then, the sheet P is switch-back conveyed by the reverse conveyance roller 31 to be fed to a duplex conveyance path (C). Then, the sheet P is conveyed again toward the secondary transfer unit through a re-feed roller 32 disposed on the duplex conveyance path so that an image is formed on a second surface opposite to the first surface, and then the sheet P is discharged outside the printer main body.

A control unit 25 as a control board on which a control circuit (electronic circuit) is formed is mounted in the printer 100. A central processing unit (CPU) 26 and a memory 27 are mounted on the control unit 25 serving as a control unit of the present embodiment. The CPU 26 controls the overall operation of the printer 100 by reading a control program from the memory 27 and executing the control program. For example, the CPU 26 controls a driving source (for example, a feed motor 34 described later) relevant to a sheet conveyance operation, controls a driving source for the process cartridges 5Y to 5K, controls the exposing unit 7, and controls a failure detection. The memory 27 includes a non-volatile storage device and a volatile storage device, serves as a storage location for a control program and data necessary for executing the control program, and provides a work place when the CPU 26 executes the control program.

The control unit 25 operates with power supplied from a switching power supply 28. The switching power supply 28 converts an AC power supply voltage input through a power supply cable 29 connected to a commercial power supply into a DC voltage used in each unit of the printer 100, and supplies the DC voltage to the control unit 25 and other devices operating with power.

The image forming unit 101 and the intermediate transfer unit 102 are examples of an image forming unit, and a direct transfer type electrophotographic unit for directly transferring a toner image formed on a photosensitive member onto a sheet without passing through an intermediate transfer body may be used. In this case, an image bearing member is the photosensitive member, a transfer roller or the like for transferring a toner image from the photosensitive member onto a sheet is the transfer member, and a position where the photosensitive member and the transfer member face each other is the image forming position. In addition, the invention is not limited to the electrophotographic unit, and an image forming unit based on an ink jet system, an offset printing system, or the like may be used as the image forming unit.

Feed Mechanism

Next, a feed mechanism 33 provided in the printer 100 will be described. The feed mechanism 33 of the present embodiment refers to a mechanism including the feed roller 14, the conveyance roller 15, the registration roller 16, the re-feed roller 32, and a driving source and a driving transmission structure for driving these roller members. The feed roller 14, the conveyance roller 15, the registration roller 16, and the re-feed roller 32 are all examples of a conveyance unit driven by a motor to convey a sheet.

Figure 2:
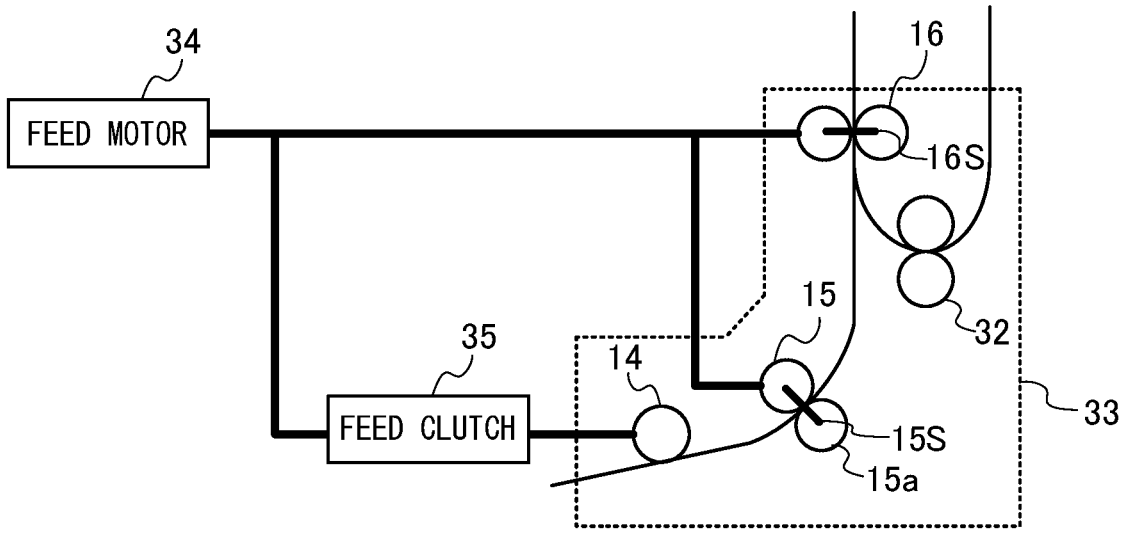
FIG. 2 is a schematic diagram showing a driving configuration of a feed mechanism according to the first embodiment.

FIG. 2 shows a driving force transmission configuration of the feed mechanism 33. The feed motor 34 is a DC motor serving as a driving source for the feed mechanism 33. The driving force of the feed motor 34 is directly transmitted to the registration roller 16 and the conveyance roller 15 through a gear train (not shown). In other words, the registration roller 16 and the conveyance roller 15 are connected to the feed motor 34 all the time, and are driven to rotate in conjunction with the rotation of the rotor of the feed motor 34.

On the other hand, a feed clutch 35 is disposed on a driving transmission path from the feed motor 34 to the feed roller 14. The feed clutch 35 is switched between an engaged state (ON state), in which the driving force of the feed motor 34 is transmitted to the feed roller 14, and a disengaged state (OFF state), in which driving transmission is interrupted, according to a command signal from the CPU 26. As the feed clutch 35, for example, an electromagnetic clutch can be used.

In addition, a sensor for detecting the passage of a sheet is disposed at at least one position on the conveyance path of a sheet conveyed by the feed mechanism 33. In the present embodiment, a conveyance sensor 15S for detecting a sheet at a detection position approximately the same as a position where the conveyance roller 15 is in contact with a sheet and a registration sensor 16S for detecting a sheet at a detection position approximately the same as a position where the registration roller 16 is in contact with a sheet are disposed. As each of the conveyance sensor 15S and the registration sensor 16S, for example, a sensor unit configured by a mechanical flag protruding to a sheet conveyance path (a space through which a sheet passes) and a photo interrupter for detecting that the mechanical flag swings due to being pressed against the sheet is used. Each of the conveyance sensor 15S and the registration sensor 16S is an example of a sheet detection unit for detecting a sheet at a predetermined detection position on the conveyance path.

Figure 3:
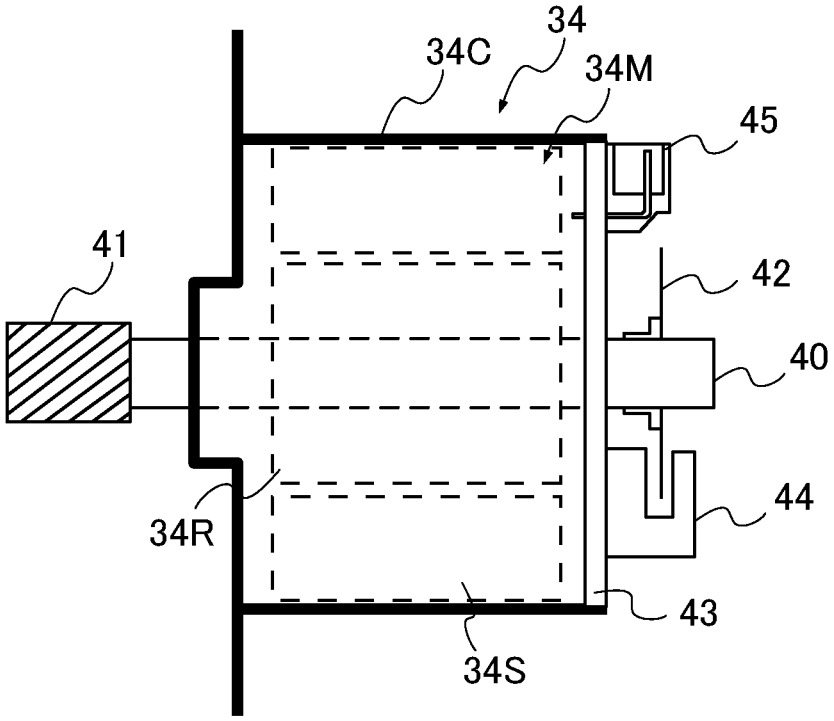
FIG. 3 is a schematic diagram of a feed motor according to the first embodiment.

FIG. 3 is a schematic diagram of the feed motor 34 according to the present embodiment. The feed motor 34 is an inner rotor type brushless motor that is a kind of a synchronous motor. That is, the feed motor 34 is a motor unit configured such that a rotation driving unit (motor main body) 34M includes a stator 34S fixed to a motor case 34C and a rotor 34R having permanent magnets attached to a plurality of positions in the rotation direction. The rotation driving unit 34M is configured such that the rotor 34R rotates when power is supplied to a plurality of coils attached to the stator 34S in a predetermined order.

On a rotation shaft 40 to which the rotor 34R is attached, an output gear 41 is attached to one end in the axial direction, and an encoder disk 42 is attached to the opposite end. In addition, the feed motor 34 includes a driver board 43 on which a driving circuit (a driver circuit unit described later) for driving a rotation driving unit by making a current flow through the coils of the stator 34S is mounted. In addition, an encoder detection unit 44 for detecting the rotational speed of the encoder disk 42 and a connector 45 serving as an interface for supply of power to the feed motor 34 and signal transmission to and from the CPU 26 are provided on the driver board 43.

Command signals transmitted from the CPU 26 to the feed motor 34 include a signal used for controlling the rotational speed of the feed motor 34, a rotation direction signal indicating a rotation direction, and a brake signal indicating deceleration. In the present embodiment, a pulse width modulation signal (PWM signal) is used for controlling the speed of the feed motor 34. On the other hand, as a signal transmitted from the feed motor 34 to the CPU 26, there is an encoder signal (a detection signal of the encoder detection unit 44) indicating the rotational speed of the feed motor 34.

Figure 4:
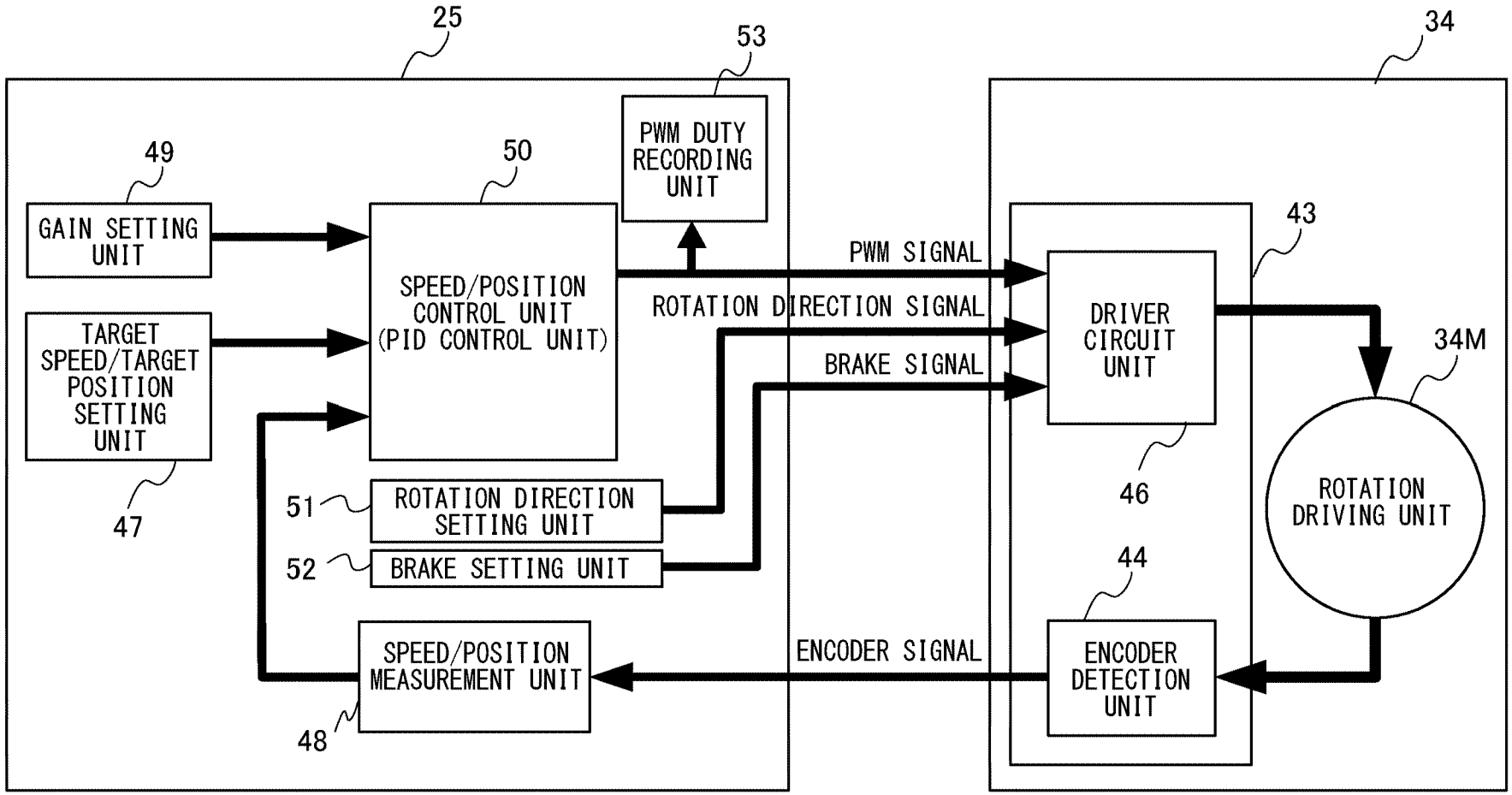
FIG. 4 is a diagram showing a control circuit of the feed motor according to the first embodiment.

FIG. 4 shows a control circuit for controlling the driving of the feed motor 34. The control unit 25 includes a speed/position control unit 50, a gain setting unit 49, a target speed/target position setting unit 47, a rotation direction setting unit 51, a brake setting unit 52, a speed/position measurement unit 48, and a PWM duty recording unit 53 as functional units relevant to the control of the feed motor 34.

The speed/position control unit 50 is a PID control unit for controlling the rotational speed and the position (rotation angle) of the feed motor 34 using PID control. That is, the speed/position control unit 50 calculates (generates) a PWM signal to be transmitted to the feed motor 34 based on the deviation between the target value of each of the rotational speed and the position of the feed motor 34 and the current value and the integration and differentiation of the deviation. The target speed/target position setting unit 47 sets the target values of the rotational speed and the position used for PID control. For example, in acceleration and deceleration control described later, the target speed/target position setting unit 47 sets the target values of the rotational speed and the position of the feed motor 34 at each point in time during the sheet conveyance operation according to the speed profile of the acceleration and deceleration control. The speed/position measurement unit 48 acquires the current values of the rotational speed and the position used for the PID control based on the encoder signal received from the feed motor 34. The gain setting unit 49 sets each control gain used for the PID control.

A driver circuit unit 46 of the feed motor 34 drives a rotation driving unit according to a received control signal. Specifically, the driver circuit unit 46 includes a switching circuit (inverter circuit) including a plurality of switching elements, such as a field effect diode (FET), and a control circuit, such as a microcomputer for operating the switching elements. The driver circuit unit 46 drives the rotation driving unit 34M by switching the path, through which a current flows, in a predetermined order to generate a rotating magnetic field for the coils of the stator. In addition, the driver circuit unit 46 has a function of generating a pseudo sine wave voltage by controlling the switching circuits based on the encoder signal and applying the pseudo sine wave voltage to the rotation driving unit 34M. In this case, the PWM signal specifies the amplitude of the sine wave. That is, the PWM signal is an example of a command signal capable of controlling the power supplied to the feed motor 34. However, the method of controlling the rotation driving unit 34M by the driver circuit unit 46 is not limited to this. For example, a rectangular wave may be output to drive the rotation driving unit 34M.

In addition, the rotation direction setting unit 51 and the brake setting unit 52 set a value of a rotation direction signal for specifying the rotation direction of the feed motor 34 and a value of a brake signal for decelerating the feed motor 34, respectively. These control signals (PWM signal, rotation direction signal, brake signal) are transmitted from the control unit 25 to the driver circuit unit 46 of the feed motor 34. The driver circuit unit 46 switches the rotation direction of the feed motor 34 based on the value of the rotation direction signal, and decelerates the rotation of the rotor of the feed motor 34 based on the value of the brake signal.

Here, the amount of current supplied to each coil of the stator 34S is controlled by the PWM signal. The PWM signal has a constant period, and is based on a modulation method in which the signal strength is represented by the length (also referred to as a pulse width or a duty cycle) of a period during which the current is ON in one period. As the pulse width becomes larger, a larger amount of current flows through the coil, and the driving torque output from the rotation driving unit 34M becomes larger. The speed/position control unit 50 changes the duty cycle of the PWM signal as needed by the PID control so that the feed motor 34 outputs a driving torque corresponding to the magnitude of the load torque.

Thus, the duty cycle of the PWM signal transmitted from the speed/position control unit 50 to the driver circuit unit 46 reflects the magnitude of the load torque applied to the feed motor 34. Therefore, in the present embodiment, the magnitude of the load torque applied to the feed motor 34 can be detected by monitoring the duty cycle of the PWM signal transmitted to the driver circuit unit 46 of the feed motor 34 by the speed/position control unit 50. The PWM duty recording unit 53 serving as a torque detection unit of the present embodiment records the duty cycle of the PWM signal transmitted from the speed/position control unit 50 to the driver circuit unit 46 of the feed motor 34, and acquires an average value (PWM_AVE) of the PWM signal used for control described later. In addition, as the torque detection unit, a component (for example, a current detection resistor connected to the coil) capable of measuring the amount of power supplied to the feed motor 34 or the value of the current flowing through the coil of the feed motor 34 may be used.

The encoder detection unit 44 provided on the driver board 43 of the feed motor 34 detects the rotation state of the rotation shaft 40 of the feed motor 34, and transmits the rotation state to the control unit 25 as an encoder signal. The speed/position measurement unit 48 of the control unit 25 calculates the current rotational speed and rotational position of the feed motor 34 by monitoring the encoder signal.

In addition, each of the functional units in the control unit 25 may be implemented as a module of a control program executed by the CPU 26, or may be implemented as a dedicated circuit, such as an ASIC. For example, setting of the target speed and the target position by the target speed/target position setting unit 47, setting of the control gain by the gain setting unit 49, and recording of the duty cycle of the PWM signal can be performed by the CPU 26 itself.

Acceleration and Deceleration Control in Sheet Conveyance Operation

Next, acceleration and deceleration control (speed control in the present embodiment) for changing the sheet conveyance speed during the sheet conveyance operation will be described with reference to FIGS. 5A to 5C. Hereinafter, the "leading edge" of a sheet refers to the downstream edge of the sheet in the sheet conveyance direction, and the "trailing edge" of the sheet refers to the upstream edge of the sheet in the sheet conveyance direction. Of two sheets continuously fed from the feed cassette 13, a sheet fed earlier is referred to as a "preceding sheet", and a sheet fed subsequent to the preceding sheet is referred to as a "succeeding sheet". In addition, the sheet conveyance speed in the secondary transfer unit is referred to as "process speed". In addition, the rotational speed of the feed motor 34 for making the peripheral speed of the registration roller 16 equal to the process speed is also referred to as "reference speed" of the feed motor 34.

In the printer 100 of the present embodiment, the sheet interval in the secondary transfer unit is set to 10 mm, and the sheet interval at the time of feeding is set to 25 mm. However, the sheet interval in the secondary transfer unit is a distance in the sheet conveyance direction from the trailing edge of the preceding sheet to the leading edge of the succeeding sheet at a point in time when the leading edge of the succeeding sheet reaches the secondary transfer unit. In addition, the sheet interval at the time of feeding is a distance in the sheet conveyance direction from the leading edge of the succeeding sheet to the trailing edge of the preceding sheet at a point in time when the feeding of the succeeding sheet is started. Specifically, the point in time when the feeding of the succeeding sheet is started is a time when the feed clutch 35 is switched from OFF (disengaged) to ON (engaged) while the feed motor 34 is rotating so that the rotation driving of the feed roller 14 is started.

Incidentally, in a case where the numerical value (25 mm) of the sheet interval at the time of feeding is a design value, the preceding sheet and the succeeding sheet are set at predetermined positions of the feed cassette 13, and there is no delay in starting the feeding of the succeeding sheet, the sheet interval at the time of actual feeding is also 25 mm. However, in the actual sheet conveyance operation, the sheet interval at the time of feeding may not be 25 mm. Factors that cause the sheet interval at the time of feeding to be larger than 25 mm include slip of the feed roller 14 and response characteristics of the feed clutch 35 (delay from the ON command from the control unit 25 to the start of the rotation driving of the feed roller 14). In addition, even when the top sheet in the feed cassette 13 is shifted from a predetermined set position in the sheet conveyance direction, the sheet interval at the time of feeding is changed.

On the other hand, from the viewpoint of improving the productivity of the image forming apparatus, it is preferable to keep the sheet interval in the secondary transfer unit as constant as possible. This is because, when the process speed is constant, the productivity can be increased by reducing the sheet interval.

In particular, in the present embodiment, a configuration is adopted in which image alignment in the sheet conveyance direction (sub-scanning direction) is performed by controlling the sheet conveyance speed without stopping the leading edge of the sheet in the registration roller 16. In this configuration, it is important to keep the sheet interval constant not only in terms of improving productivity but also in terms of improving the accuracy of image position.

Therefore, in the present embodiment, acceleration and deceleration control is performed during the sheet conveyance operation, thereby changing the sheet conveyance speed so that the sheet interval in the secondary transfer unit is 10 mm even in a case where the sheet interval at the time of feeding is shifted from 25 mm.

Figure 5C:
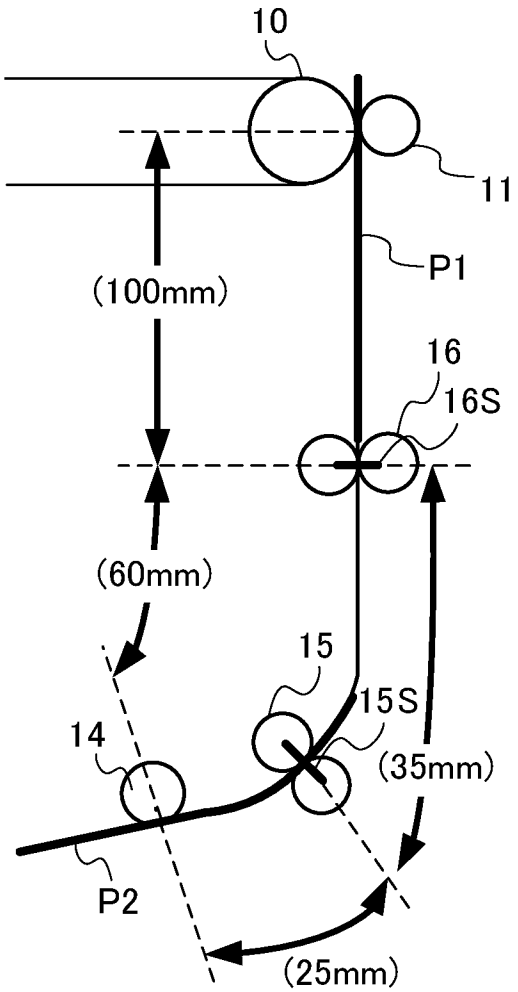
FIGS. 5B and 5C are diagrams showing the position of a sheet in a sheet feeding operation.
Figure 5B:
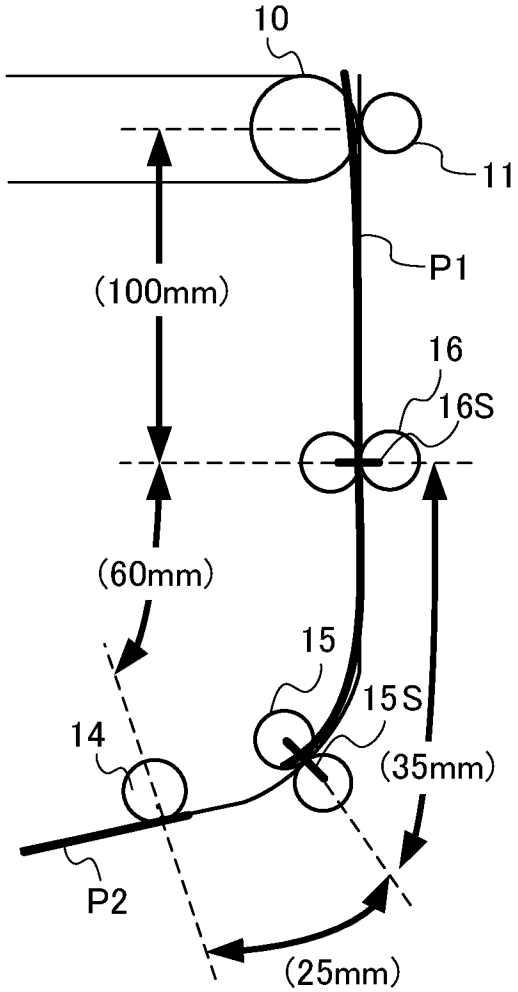
Figure 5A:
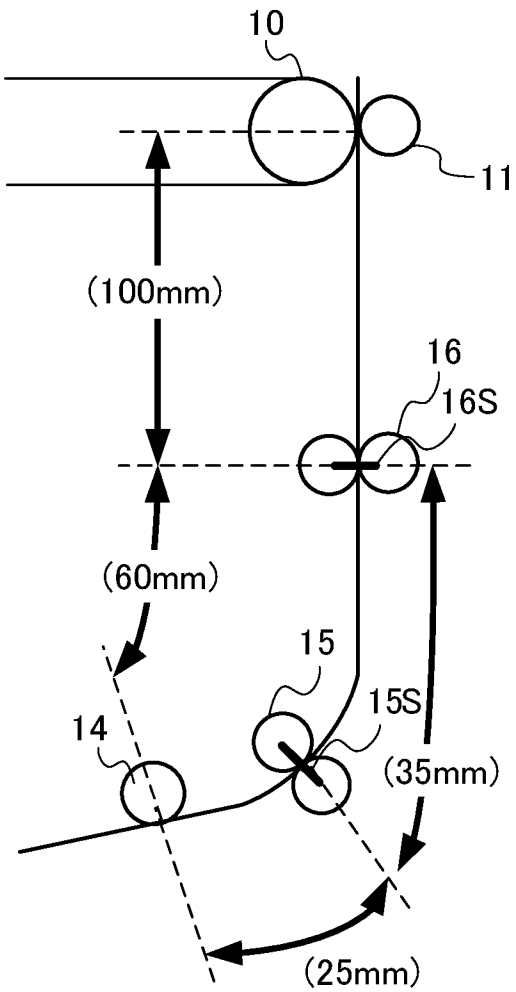
FIG. 5A is a diagram showing an arrangement of a sheet conveyance path according to the first embodiment.

FIG. 5A shows a positional relationship between rollers on the conveyance path from the feed roller 14 to the secondary transfer unit. In the present embodiment, it is assumed that the distance from the feed roller 14 to the separation nip is 25 mm, the distance from the separation nip to the nip portion of the registration roller 16 is 35 mm, and the distance from the nip portion of the registration roller 16 to the secondary transfer unit is 100 mm.

FIGS. 5B and 5C show the state of an operation of conveying a preceding sheet and a succeeding sheet in the case of continuous single-sided printing in which a plurality of sheets are continuously fed one by one from the feed cassette 13 to form an image on one side of the sheet. In the present embodiment, since the sheet interval at the time of feeding is set to 25 mm, as shown in FIG. 5B, the feed clutch 35 is switched to ON when the trailing edge of a preceding sheet P1 passes through the separation nip and accordingly the feeding of the succeeding sheet P2 is started. At this time, since the trailing edge of the preceding sheet has not passed through the registration roller 16 driven by the feed motor 34, the rotational speed of the feed motor 34 needs to be maintained at a speed at which the peripheral speed of the registration roller 16 becomes the process speed. This is because, in a case where the rotational speed of the feed motor 34 is changed at the start of the feeding of the succeeding sheet P2, the peripheral speed of the registration roller 16 becomes higher than the process speed and accordingly the sheet may be bent between the registration roller 16 and the secondary transfer unit, and this may distort the transfer image.

As shown in FIG. 5C, when the trailing edge of the preceding sheet P1 passes through the registration roller 16, the rotational speed of the feed motor 34 is temporarily accelerated to a speed higher than a reference speed corresponding to the process speed, and thereafter, decelerated to the reference speed. As a result, the leading edge of the succeeding sheet P2 approaches the trailing edge of the preceding sheet P1 being conveyed at the process speed by 10 mm. Thereafter, the succeeding sheet P2 passes through the secondary transfer unit while being conveyed at the process speed, so that a toner image is transferred to a predetermined position on the sheet.

Speed Profile of Acceleration and Deceleration Control

Figure 6:
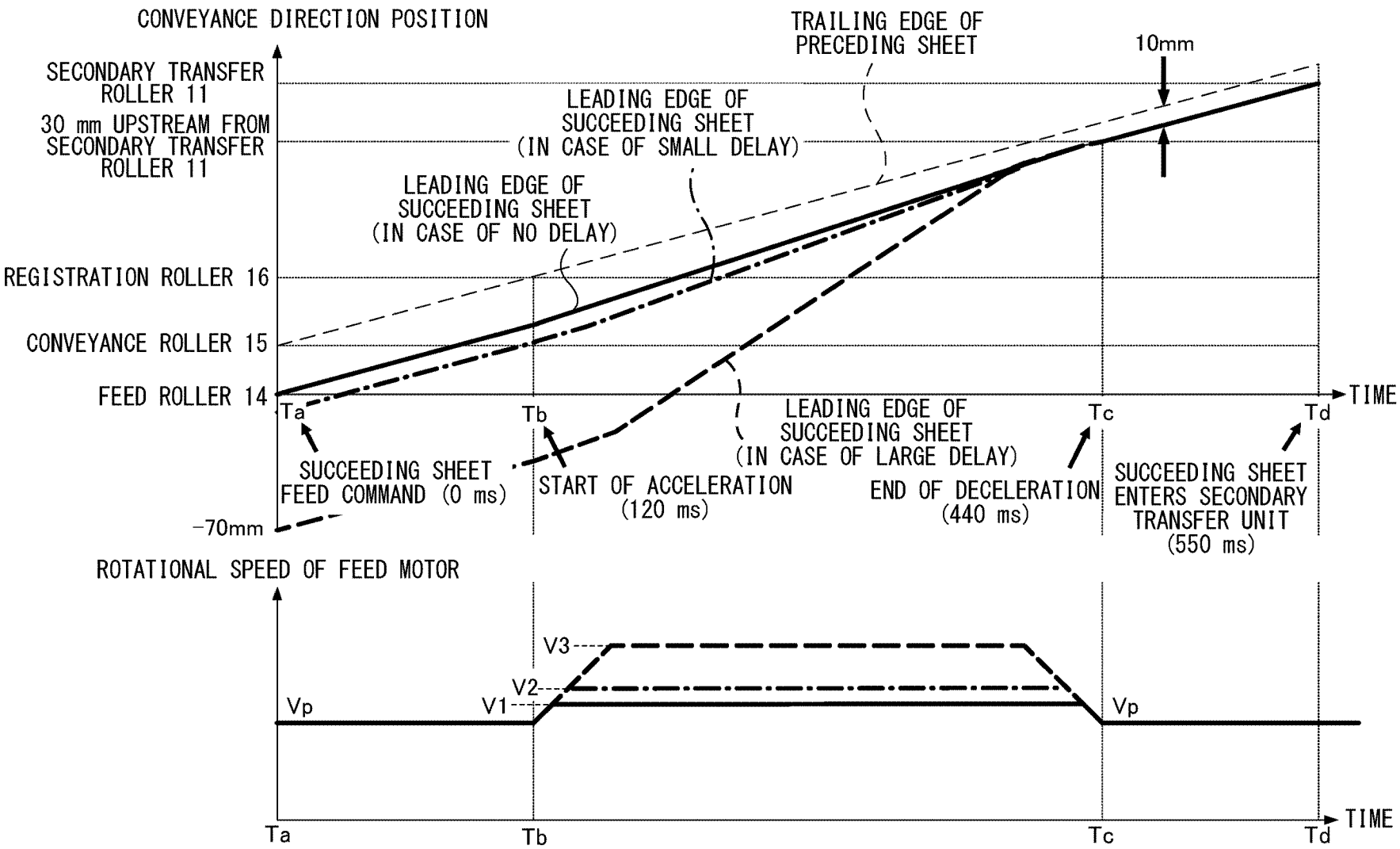
FIG. 6 is a diagram showing a transition of the leading edge position of a sheet and a sheet conveyance speed in a reference example.

Next, the basic content of the acceleration and deceleration control will be described with reference to FIG. 6. The upper part of FIG. 6 is a diagram showing an example of transition of the leading edge position of a succeeding sheet in the case of performing continuous single-sided printing using a sheet stacked on the feed cassette 13, and the lower part of FIG. 6 shows the transition of the rotational speed of a feed motor. The horizontal axis (time) of the upper part and the lower part in FIG. 6 is common.

Before the feeding of a succeeding sheet is started, a preceding sheet is assumed to be conveyed at a constant process speed. Therefore, the trailing edge of the preceding sheet (thin broken line in the upper part of FIG. 6) sequentially passes through the positions of the feed roller 14, the conveyance roller 15, the registration roller 16, and the secondary transfer roller 11 at the process speed.

In the case of continuous single-sided printing, the feed clutch 35 is engaged at a timing Ta at which the sheet interval between the preceding sheet and the succeeding sheet is 25 mm and accordingly, the feeding of the succeeding sheet is started by the feed roller 14. At this time, in a case where the feeding of the succeeding sheet is delayed due to the influence of slip of the feed roller 14 or the like, the succeeding sheet may be fed in a state in which the leading edge of the actual succeeding sheet is more than 25 mm away from the trailing edge of the preceding sheet (the sheet interval at the time of feeding is larger than 25 mm). At the upper end of FIG. 6, a solid line indicates a case where there is almost no delay of the succeeding sheet, a one-dot chain line indicates a case where a relatively small delay occurs in the succeeding sheet, and a broken line indicates a case where a relatively large delay occurs in the succeeding sheet.

On the other hand, the target value (target interval) of the sheet interval in the secondary transfer unit is set to 10 mm. Therefore, even though there is no delay in the feeding of the succeeding sheet, it is necessary to reduce the sheet interval before the succeeding sheet reaches the secondary transfer unit. In the present embodiment, the following description will be given on the assumption that the sheet interval is reduced to 10 mm up to a position 30 mm upstream from the secondary transfer roller 11 so that the leading edge of the sheet enters the secondary transfer unit in a state in which the sheet conveyance speed is stable. That is, the position 30 mm upstream from the secondary transfer roller 11 (a position 30 mm upstream from the secondary transfer unit) corresponds to a target point of the speed control of the present embodiment for controlling the sheet conveyance speed.

Hereinafter, the state of the acceleration and deceleration control according to the degree of delay of the succeeding sheet will be described. However, in the reference example (FIG. 6) described herein, it is assumed that a predetermined constant value is used as a target value of the sheet interval between a sheet (succeeding sheet) to be subjected to the acceleration and deceleration control and a preceding sheet preceding the sheet to be subjected to the acceleration and deceleration.

1. Case where there is No Delay of a Succeeding Sheet

When there is almost no delay in feeding the succeeding sheet, that is, when the succeeding sheet is fed with the sheet interval with respect to the preceding sheet being approximately equal to 25 mm, acceleration and deceleration control on the feed motor 34 may be performed so as to reduce the sheet interval from 25 mm to 10 mm. At the timing Ta, since the preceding sheet is interposed between the registration rollers 16, the rotational speed of the feed motor 34 is a reference speed Vp corresponding to the process speed. Thereafter, at a timing Tb when the trailing edge of the preceding sheet has passed through the registration roller 16, the acceleration of the feed motor 34 is started with a speed (V1) higher than the reference speed Vp as a target.

A target speed V1 is set based on the delay amount of the succeeding sheet, such that the sheet interval between the preceding sheet and the succeeding sheet is reduced to 10 mm before the leading edge of the succeeding sheet reaches a target point (point 30 mm upstream from the secondary transfer roller 11). More precisely, a value obtained by integrating the difference between the moving velocity of the succeeding sheet and the moving velocity (=process speed) of the preceding sheet during the execution of the acceleration and deceleration control including the acceleration of the feed motor and the deceleration of the feed motor over the execution period of the acceleration and deceleration control is the sheet interval reduced by the acceleration and deceleration control. Therefore, when there is almost no delay in feeding the succeeding sheet, the target speed V1 for the acceleration and deceleration control is determined such that the sheet interval reduced by the acceleration and deceleration control (a distance at which the succeeding sheet catches up with the preceding sheet by the acceleration and deceleration control) becomes 25−10=15 [mm].

After the feed motor 34 is accelerated to the target speed V1 and maintained at the target speed V1, the feed motor 34 is decelerated to the reference speed Vp. At this time, the deceleration start timing is determined according to the magnitude of the target speed V1 so that the deceleration of the feed motor 34 is completed at a timing Tc when the leading edge of the succeeding sheet reaches a point 30 mm upstream from the secondary transfer roller 11. The acceleration and deceleration control on the feed motor 34 in the present embodiment refers to a process from the start of the acceleration of the feed motor 34 at the timing Tb to the completion of the deceleration of the feed motor 34 at the timing Tc.

At the timing Tc when the leading edge of the succeeding sheet reaches a point 30 mm upstream from the secondary transfer roller 11, the distance from the trailing edge of the preceding sheet to the leading edge of the succeeding sheet is reduced to 10 mm. Thereafter, the rotational speed of the feed motor 34 is maintained at the reference speed Vp corresponding to the process speed until the trailing edge of the succeeding sheet passes through the registration roller 16, and the succeeding sheet reaches the secondary transfer unit at a timing Td. Therefore, the succeeding sheet is conveyed at the process speed while maintaining the sheet interval of 10 mm with respect to the preceding sheet, and passes through the secondary transfer unit. As a result, a toner image is transferred onto the sheet surface.

2. Case where a Relatively Small Delay Occurs in the Feeding of a Succeeding Sheet The one-dot chain line in FIG. 6 shows, as an example of the case where a relatively small delay occurs in the feeding of the succeeding sheet, a case where the succeeding sheet is fed at a distance of about 35 mm from the trailing edge of the preceding sheet (a case where the delay amount of the succeeding sheet is about 10 mm). For example, in a case where the timing at which the leading edge of the succeeding sheet is detected by the conveyance sensor 15S is delayed from the timing in a case where the succeeding sheet is fed with a delay of 25 mm from the trailing edge of the preceding sheet, it can be seen that there is a delay in feeding the succeeding sheet.

In addition, the delay amount of the succeeding sheet can be acquired based on, for example, the timing at which the conveyance sensor 15S (FIGS. 5A to 5C) detects the leading edge of the succeeding sheet. For example, "the delay amount of the succeeding sheet is 10 mm" means that, at the timing when the position of the succeeding sheet is determined by the conveyance sensor 15S or the like, the leading edge position of the succeeding sheet is delayed by 10 mm from that in a case where there is no delay in feeding the succeeding sheet. In addition, in FIG. 6, by extrapolating the graph based on the delay amount of the succeeding sheet detected by the conveyance sensor 15S or the like, the leading edge position of the succeeding sheet is also shown for a time zone before the conveyance sensor 15S or the like detects the succeeding sheet. In practice, however, there is a period during which the leading edge of the succeeding sheet stays near the feed roller 14 due to slip of the feed roller 14 or response delay of the feed clutch 35. As a result, the feeding of the succeeding sheet is delayed.

In a case where there is a delay in feeding the succeeding sheet, it is necessary to further increase the sheet interval to be reduced by the acceleration and deceleration control. Here, since it is assumed that the delay amount is about 10 mm, a target speed V2 for the acceleration and deceleration control is determined so that the sheet interval to be reduced by the acceleration and deceleration control becomes 25 mm. The target speed V2 is a value larger than the target speed V1 for the acceleration and deceleration control in a case where there is almost no feed delay.

Except that the target speed V2 is different, the content of the acceleration and deceleration control is the same as in the case where there is almost no feed delay. That is, processing for accelerating the feed motor 34 from the reference speed Vp to the target speed V2 is started at the timing Tb. Thereafter, processing for decelerating the feed motor 34 from the reference speed Vp to the reference speed Vp is started at a timing corresponding to the magnitude of the target speed V2 such that the feed motor 34 is decelerated to the reference speed Vp at the timing Tc when the leading edge of the succeeding sheet reaches a target point. As a result, when the leading edge of the succeeding sheet reaches the target point, the distance from the trailing edge of the preceding sheet to the leading edge of the succeeding sheet is reduced to 10 mm.

3. Case where a Relatively Large Delay Occurs in the Feeding of a Succeeding Sheet The broken line in FIG. 6 shows, as an example of the case where a relatively large delay occurs in the feeding of the succeeding sheet, a case where the succeeding sheet is fed at a distance of about 95 mm from the trailing edge of the preceding sheet (a case where the delay amount of the succeeding sheet is about 70 mm). When such a large delay occurs, it is necessary to further increase the sheet interval to be reduced by the acceleration and deceleration control. Specifically, a target speed V3 for the acceleration and deceleration control is determined so that the sheet interval to be reduced by the acceleration and deceleration control becomes 85 mm. The target speed V3 is a value larger than the target speed V2 for the acceleration and deceleration control when the feed delay is relatively small.

Except that the target speed V3 is different, the content of the acceleration and deceleration control is the same as in the case where there is almost no feed delay. That is, processing for accelerating the feed motor 34 from the reference speed Vp to the target speed V3 is started at the timing Tb. Thereafter, processing for decelerating the feed motor 34 from the target speed V3 to the reference speed Vp is started at a timing corresponding to the magnitude of the target speed V3 such that the feed motor 34 is decelerated to the reference speed Vp at the timing Tc when the leading edge of the succeeding sheet reaches a target point. As a result, when the leading edge of the succeeding sheet reaches the target point, the distance from the trailing edge of the preceding sheet to the leading edge of the succeeding sheet is reduced to 10 mm.

In addition, in a case where the feeding of the succeeding sheet is greatly delayed as indicated by the broken line, the conveyance sensor 15S may not detect the leading edge of the succeeding sheet even at the timing Tb. Also in such a case, in the present embodiment, it is determined that a feed delay has occurred in the succeeding sheet based on the fact that the conveyance sensor 15S has not detected the sheet, and the acceleration and deceleration control on the feed motor 34 is performed at the timing Tb. When the acceleration and deceleration control is started, the feed motor 34 is accelerated to the temporary target speed V3 higher than the reference speed Vp. In this case, when the conveyance sensor 15S detects the leading edge of the succeeding sheet after the timing Tb, a more appropriate target speed is set again in order to reduce the sheet interval to 10 mm by the acceleration and deceleration control.

In addition, in a case where the conveyance sensor 15S has not yet detected the succeeding sheet even after a predetermined time has passed from the timing Tb, it is determined that an abnormality (feed failure) in the conveyance operation has occurred and the job is interrupted. The length of the predetermined time by which determination as a feed failure is made corresponds to, for example, a delay amount at which the sheet interval cannot be reduced to 10 mm up to the target point even though the feed motor 34 is accelerated to the maximum speed. Such target speed resetting can be performed even when there is almost no delay in feeding the succeeding sheet or when the delay is relatively small.

Rotational Speed of a Motor in Acceleration and Deceleration Control

As described above, it is possible to keep the sheet interval in the secondary transfer unit constant by performing acceleration and deceleration control on the feed motor 34 based on the degree of delay in feeding the succeeding sheet detected by the conveyance sensor 15S or the like.

Incidentally, as shown in the lower part of FIG. 6, as the delay amount of the succeeding sheet becomes larger, the target speed for the acceleration and deceleration control required to recover the delay is set to a larger value (V1<V2<V3). When the output of the motor is insufficient for the target speed required to recover the feed delay, the sheet interval cannot be reduced to 10 mm up to the target point. This may cause image defects, or an abnormality in the conveyance operation will be detected. In addition, even under the conditions in which a large load torque is applied to the motor (conditions disadvantageous for the acceleration of the motor), such as a state in which the rolling resistance has increased due to the wear of the roller member or a case where a sheet with large conveyance resistance is conveyed, it is necessary to avoid such a disadvantage.

Therefore, in a configuration in which the maximum speed for the acceleration and deceleration control can be increased as shown in FIG. 6, it is necessary to select a high-output motor so that the sheet interval can be stably reduced to the target value up to the target point. The use of such a high-output motor increases the cost, and also increases the apparatus size by increasing the size of the motor itself.

When the target value of the sheet interval in the acceleration and deceleration control is set to a larger value (in the above-described example, an interval larger than 10 mm), such a disadvantage is avoided. However, when the target value of the sheet interval is simply increased, the sheet interval in the secondary transfer unit is increased and accordingly, the productivity of the image forming apparatus is reduced.

Therefore, the inventors have studied a method capable of stably controlling the sheet interval even when a low-output motor is used by examining the relationship between the magnitude of the load torque applied to the motor and the sheet interval that can be reduced by the acceleration and deceleration control.

Figure 7:
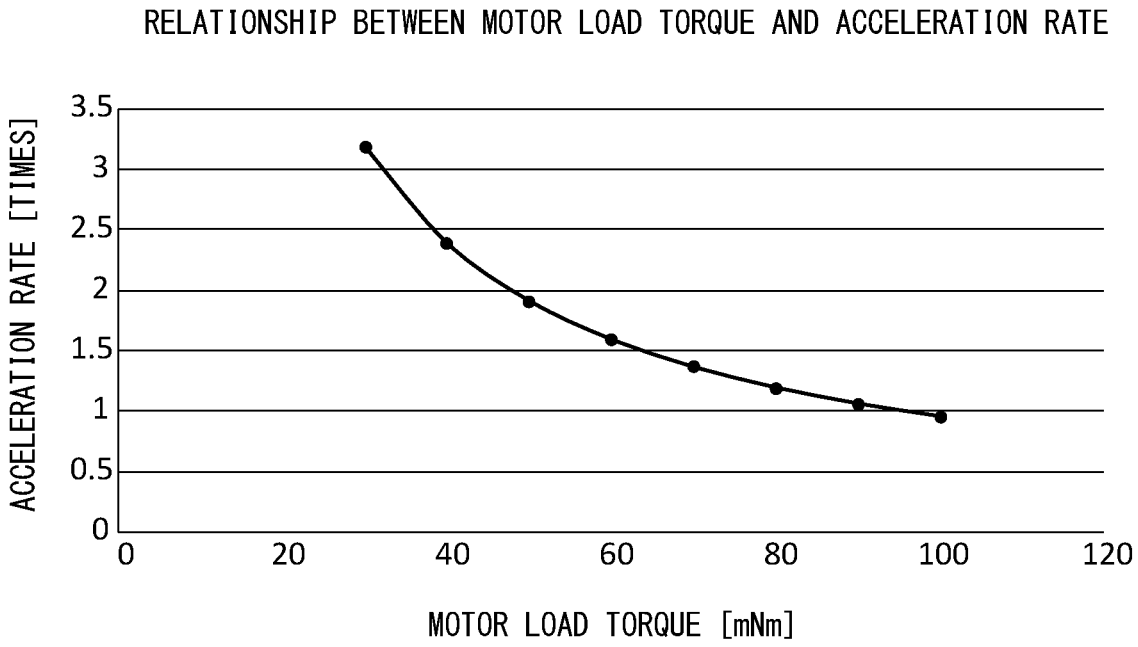
FIG. 7 is a graph showing a relationship between the acceleration rate and the load torque of the feed motor according to the first embodiment.

FIG. 7 is a graph showing a relationship between the magnitude of the motor load torque and the acceleration rate. The magnitude of the motor load torque on the horizontal axis indicates the magnitude of the load torque applied to the feed motor 34. The acceleration rate on the vertical axis is a ratio of the maximum speed, which can be output by the feed motor 34 in the acceleration and deceleration control, to the rotational speed (reference speed Vp) before acceleration.

As can be seen from FIG. 7, there is a relationship that the larger the motor load torque, the smaller the acceleration rate in the acceleration and deceleration control (that is, the smaller the maximum speed that can be output by the feed motor 34). This is because, as the load torque applied to the feed motor 34 increases, the acceleration that can be output by the feed motor 34 decreases and accordingly, the maximum speed that can be reached during the execution period of the acceleration and deceleration control decreases.

Therefore, it can be seen that, in a case where a large feed delay occurs when the load torque applied to the feed motor 34 is large, it is difficult to reduce the sheet interval by the acceleration and deceleration control unless a high-output motor is used. At the same time, it can be seen that, when the load torque applied to the feed motor 34 is small, the sheet interval can be sufficiently reduced even with a low-output motor even though a relatively large feed delay occurs.

Since the magnitude of the load torque applied to the motor changes depending on the above-described various conditions, it is assumed that the magnitude of the load torque applied to the motor is determined based on the measurement value of the load torque (or a physical quantity correlated to the load torque) measured when the sheet is actually conveyed. As will be described in detail later, in the present embodiment, the target value of the sheet interval for the second and subsequent sheets is changed based on the average value of the duty cycle of the PWM signal for the feed motor 34 when the conveyance operation is performed on the first sheet in the job.

Control Example

Figure 8:
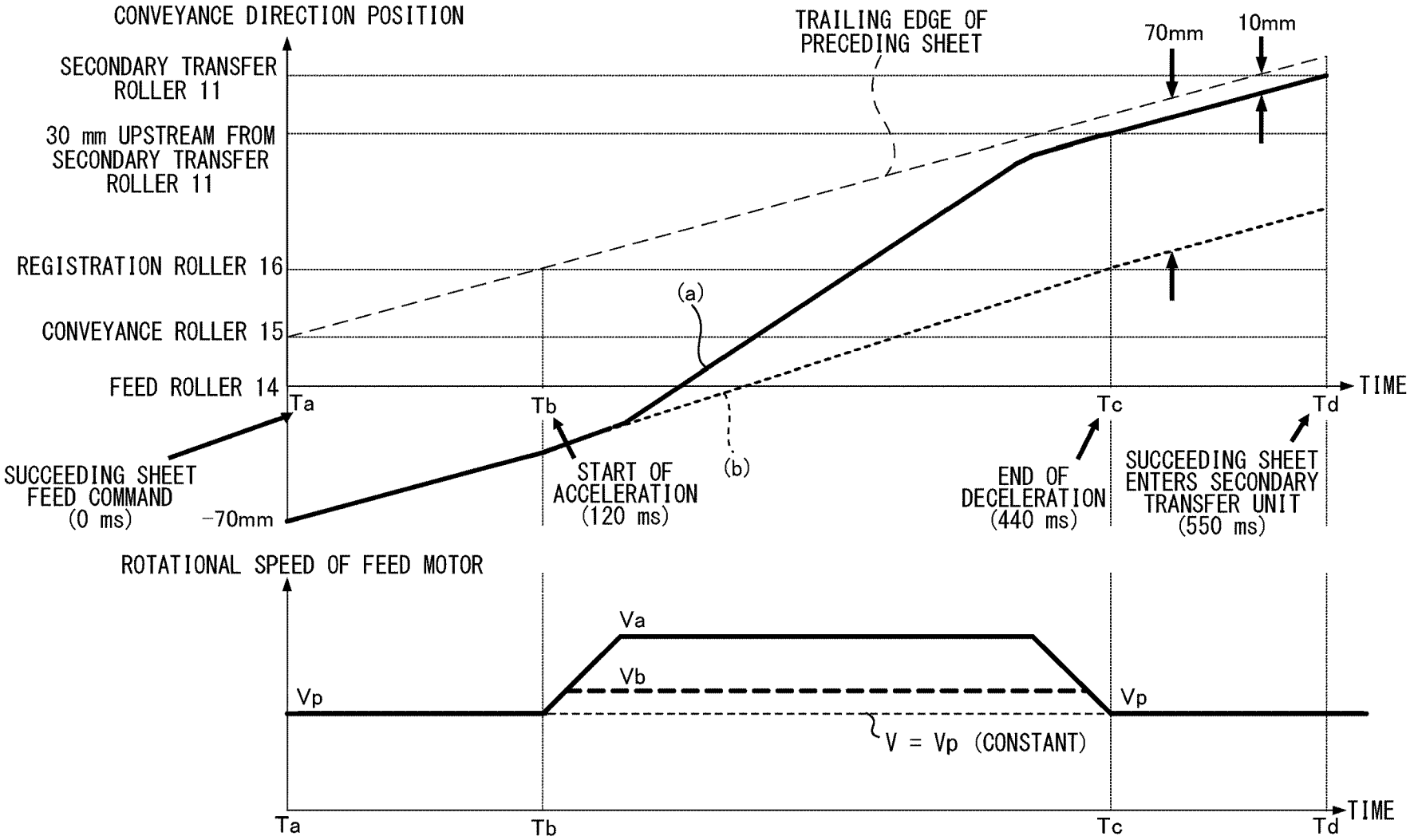
FIG. 8 is a diagram showing a transition of the leading edge position of a sheet and a sheet conveyance speed in the first embodiment.

FIG. 8 shows an operation example of the acceleration and deceleration control to which the present embodiment is applied. The upper part of FIG. 8 is a diagram showing an example of transition of the leading edge position of a succeeding sheet in the case of performing continuous single-sided printing using a sheet stacked on the feed cassette 13, and the lower part of FIG. 8 shows the transition of the rotational speed of a feed motor. The horizontal axis (time) of the upper part and the lower part in FIG. 8 is common.

As in the reference example described with reference to FIG. 6, the preceding sheet is conveyed at a constant process speed, and the feeding of the succeeding sheet is started at a timing when the sheet interval with respect to the preceding sheet becomes 25 mm. Here, the change of the acceleration and deceleration control due to the difference in the target value of the sheet interval will be described assuming that a feed delay occurs in the succeeding sheet due to slip of the feed roller 14 or the like.

In the upper part of FIG. 8, the solid line (a) indicates a transition of the leading edge position of a sheet when it is determined that the load torque applied to the feed motor 34 is large. In this case, a small value (10 mm) is selected as the target interval. A target speed Va of the speed profile is set such that the sheet interval is reduced to 10 mm before the sheet reaches the target point. That is, since the amount of feed delay to be recovered by the acceleration and deceleration control is large, the target speed Va in the acceleration and deceleration control is set to a relatively large value.

In addition, the target speed Va is a speed in a constant speed section between an acceleration section and a deceleration section in the speed profile of the acceleration and deceleration control. However, the acceleration section of the speed profile is a section in which the rotational speed of the motor is accelerated from a first speed (here, Vp) before performing the acceleration and deceleration control to a second speed (here, Va) higher than the first speed. In addition, the deceleration section of the speed profile is a section in which the rotational speed of the motor is reduced from the second speed (here, Va) to a third speed (here, Vp) lower than the second speed.

In the upper part of FIG. 8, a broken line (b) indicates a transition of the leading edge position of a sheet when it is determined that the load torque applied to the feed motor 34 is small. In this case, a large value (70 mm) is selected as the target interval. A target speed Vb of the speed profile is set such that the sheet interval is reduced to 70 mm before the sheet reaches the target point. That is, since the amount of feed delay to be recovered by the acceleration and deceleration control is small, the target speed Vb in the acceleration and deceleration control is set to a relatively small value.

Comparing the solid line (a) and the broken line (b) in the lower part of FIG. 8, it can be seen that, under the conditions in which the degree of feed delay is the same but the load torque applied to the feed motor 34 is large, the maximum speed of the acceleration and deceleration control is suppressed (Va>Vb) and the target value of the sheet interval is increased instead. For this reason, in a case where a low-output motor is used, it is possible to stably control the sheet interval even under the conditions in which the load torque applied to the feed motor 34 is large. On the other hand, under the conditions in which the load torque applied to the feed motor 34 is small, the target value of the sheet interval can be reduced to improve the productivity of the image forming apparatus.

In FIG. 8, the description is based on the assumption that a relatively large feed delay occurs. In practice, however, in both the case where the load torque applied to the feed motor 34 is large and the case where the load torque applied to the feed motor 34 is small, the feed delay may be smaller than that in the example shown in FIG. 8. However, by setting the target value of the sheet interval, which can be sufficiently realized even with a low-output motor, in consideration of a case where the feed delay is large, the sheet interval can be stably controlled.

Figure 9:
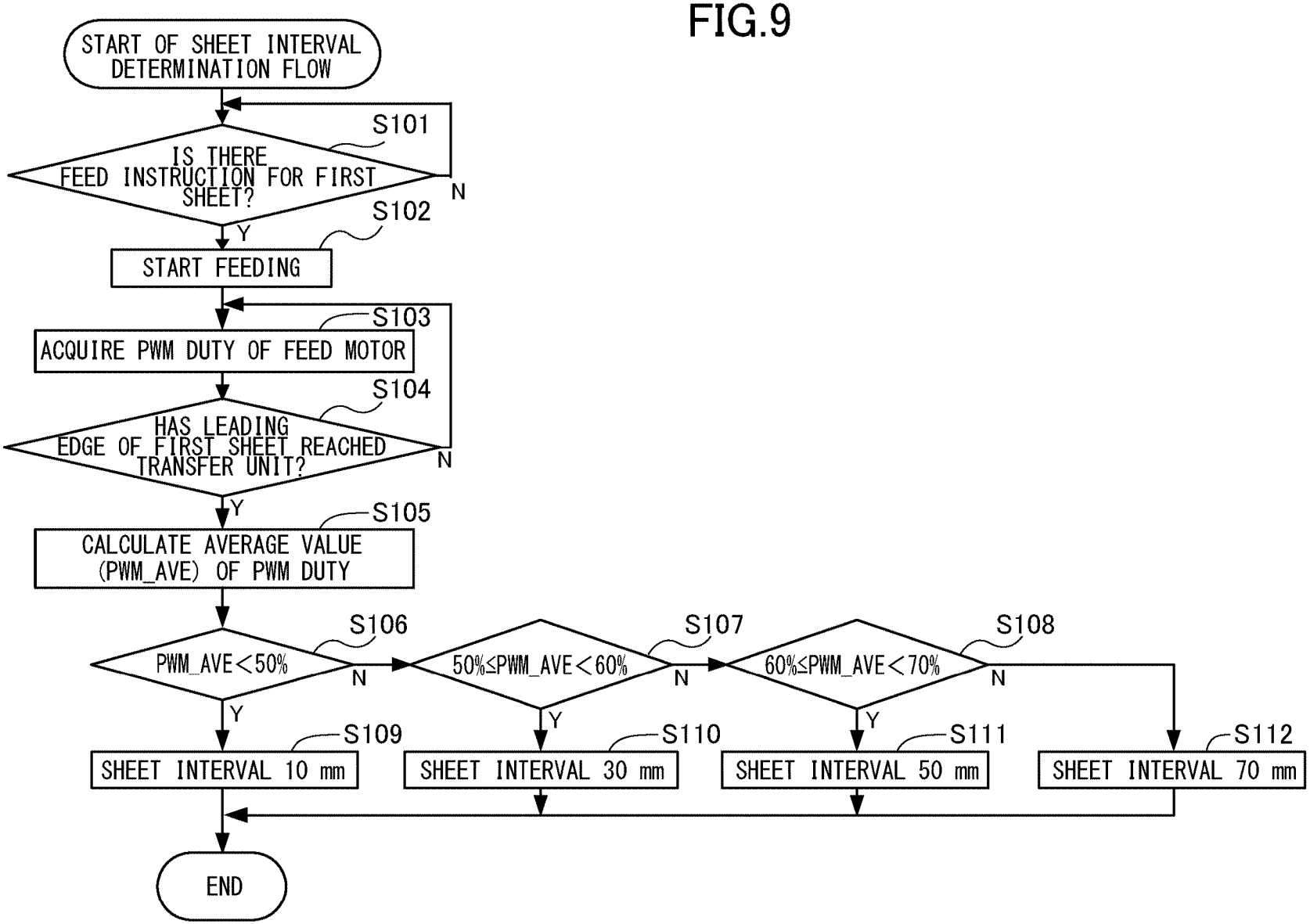
FIG. 9 is a flowchart showing a control method of the image forming apparatus according to the first embodiment.

A control method of the image forming apparatus for realizing the above-described operation will be described with reference to FIG. 9. FIG. 9 is a flowchart of a process for determining a target value of the sheet interval in the present embodiment. It is assumed that each step of this process is performed by reading and executing a control program stored in the memory 27 by the CPU 26 (FIG. 1). In addition, this process is started when the CPU 26 executes a series of tasks (image forming job; hereinafter simply referred to as a job) for forming an image while feeding a predetermined number of sheets one by one and discharging the sheets.

When there is a feed instruction for the first sheet in the job (S101), the CPU 26 causes the feed roller 14 to start feeding the first sheet by rotating the feed motor 34 and engaging the feed clutch 35 (S102). The CPU 26 records the duty cycle (PWM duty) of the PWM signal transmitted to the driver circuit unit 46 of the feed motor 34 during a period from the start of the feeding of the first sheet to a time when the leading edge of the first sheet reaches the secondary transfer unit (S103 and S104). Then, when the leading edge of the sheet reaches the secondary transfer unit, an average value PWM_AVE of the PWM duty is calculated (S105).

The CPU 26 determines a target value of the sheet interval for the second and subsequent sheets according to the value of PWM_AVE acquired in the above-described procedure by performing a conveyance operation for the first sheet (S106 to S112). At this time, the conditions are set such that as the value of PWM_AVE increases, the target value of the sheet interval increases. In the example shown in FIG. 9, the conditions are set as follows.

Target interval when PWM_AVE is less than 50%: 10 mm

Target interval when PWM_AVE is 50% or more and less than 60%: 30 mm

Target interval when PWM_AVE is 60% or more and less than 70%: 50 mm

Target interval when PWM_AVE is 70% or more: 70 mm

That is, in the present embodiment, the target interval is set to a first interval when PWM_AVE is a first value, and the target interval is set to a second interval larger than the first interval when PWM_AVE is a second value larger than the first value. For example, assuming that the first value and the second value are 35% and 55%, respectively, the first interval and the second interval in the control example shown in FIG. 9 are 10 mm and 30 mm, respectively.

When the target value of the sheet interval in the acceleration and deceleration control is determined by the above processing, in the acceleration and deceleration control for the second and subsequent sheets in the job, the speed profile is determined according to the determined target value of the sheet interval and the detection timing of the conveyance sensor 15S or the like. As a result, as shown in FIG. 9, the sheet interval can be stably controlled even when a low-output motor is used.

In S104 of the process, the timing at which the leading edge of the first sheet reaches the secondary transfer unit can be determined based on, for example, the time elapsed from the detection of the leading edge of the sheet by the registration sensor 16S (FIG. 2) and the conveyance speed of the first sheet. In addition, when conveying the first sheet, acceleration and deceleration control to make the sheet interval approach the target interval is not performed, but acceleration and deceleration control for alignment between the image and the sheet in the secondary transfer unit may be performed.

In addition, the conditions for selecting the target value of the sheet interval according to the average value PWM_AVE of the PWM duty and the value of the target interval are merely examples, and can be appropriately changed. For example, the value of PWM_AVE may be divided into five or more levels, and a target interval corresponding to each level may be determined in advance.

Summary of the Present Embodiment

As described above, in the present embodiment, the processing (S106 to S112 in FIG. 9) for changing the target value of the sheet interval in the acceleration and deceleration control is performed based on the measurement result of the PWM duty when the feed motor 34 is rotated. In other words, an interval change processing for changing the target interval in the case of performing speed control during the conveyance operation is performed based on the magnitude of the load torque detected by the torque detection unit when the conveyance unit is driven by the motor. As a result, under the conditions in which the load torque applied to the motor is large, it is possible to more reliably control the sheet interval by increasing the target interval. In addition, under the conditions in which the load torque applied to the motor is small, it is possible to improve the productivity of the image forming apparatus by decreasing the target interval. That is, according to the present embodiment, it is possible to stably control the sheet interval even when the output of the motor is low and to achieve the highest possible productivity according to the load torque applied to the motor.

In addition, in the present embodiment, when a job for forming an image on a plurality of sheets is executed, the target value of the sheet interval in the acceleration and deceleration control for the second and subsequent sheets is determined based on the load torque applied to the feed motor 34 when the conveyance operation for the first sheet is performed. As a result, it is possible to determine a more appropriate target value of the sheet interval each time the job is executed.

Modification Example

The timing at which the target value of the sheet interval is changed according to the load torque (the timing at which the load torque used for interval change processing is acquired) is not limited to the case where the first sheet in the job is conveyed. For example, in a case where it is known that the same sheet as that used when the previous job was executed is stacked on the feed cassette 13, it is conceivable that the target interval set when the previous job was executed is continuously used in the current job. The "same sheet" means, for example, that the size and the type (grammage, material, presence or absence of a coat layer, and the like) are the same, and the determination can be made based on information input through the operation panel of the image forming apparatus or information acquired by a size detection sensor provided in the feed cassette 13. In addition, in a preparation period (during an initial operation) before feeding the first sheet after the job is input, the target value of the sheet interval may be determined based on the PWM duty when the feed motor 34 is rotated for a predetermined time while the feed clutch 35 is disengaged.

In addition, in the present embodiment, the target interval is determined based on the average value of the PWM duty for a predetermined period (from the start of feeding to the arrival at the secondary transfer unit) in the sheet conveyance operation. However, the load torque of the feed motor 34 may be detected using a method different from this. For example, the average value of the PWM duty in a period from when the leading edge of the sheet is detected by the conveyance sensor 15S to when the leading edge of the sheet is detected by the registration sensor 16S (another example of the predetermined period) may be treated as the magnitude of the load torque applied to the feed motor 34. Instead of the average value of the PWM duty, the target interval may be determined based on the maximum value of the PWM duty during the predetermined period.

Instead of using the measurement result of the load torque when one sheet is conveyed, the target interval may be determined based on the average value of the measurement results of the load torque when plural sheets are conveyed. In addition, by determining the target interval for the succeeding sheet according to the load torque when the preceding sheet (not necessarily the first sheet) is conveyed, the target interval may be changed as needed during the execution of the j ob.

Second Embodiment

Next, the configuration of an image forming apparatus according to a second embodiment will be described. The present embodiment is different from the first embodiment in that the target value of the sheet interval when another sheet is conveyed is changed according to the degree of delay in feeding a certain sheet in addition to the detection result of the load torque applied to the motor when the sheet is conveyed. Other components having the same configurations and operations as those in the first embodiment are denoted by the same reference numerals as those in the first embodiment, and the description thereof is omitted.

In the first embodiment, assuming a situation in which the amount of feed delay is large, a target value of the sheet interval that can be realized even with a low-output motor is determined for each condition regarding the magnitude of the load torque applied to the feed motor. However, when it is known that the amount of feed delay that actually occurs is small, the stability of the control of the sheet interval is not adversely affected even in a case where the target value of the sheet interval is set to a smaller value.

Here, one of the main factors causing the feed delay is that the frictional force on the sheet decreases due to the wear of the feed roller 14 and the slip of the feed roller 14 increases. For this reason, when the feed delay amount when a certain sheet is conveyed is known, it is possible to predict the range of the feed delay amount when another sheet is conveyed or the maximum value thereof. Therefore, in the present embodiment, when the first sheet in the job is conveyed, the feed delay amount of the sheet is acquired in addition to the load torque applied to the feed motor, and the target value of the sheet interval for the second and subsequent sheets is determined based on the load torque and the feed delay amount.

Figure 10:
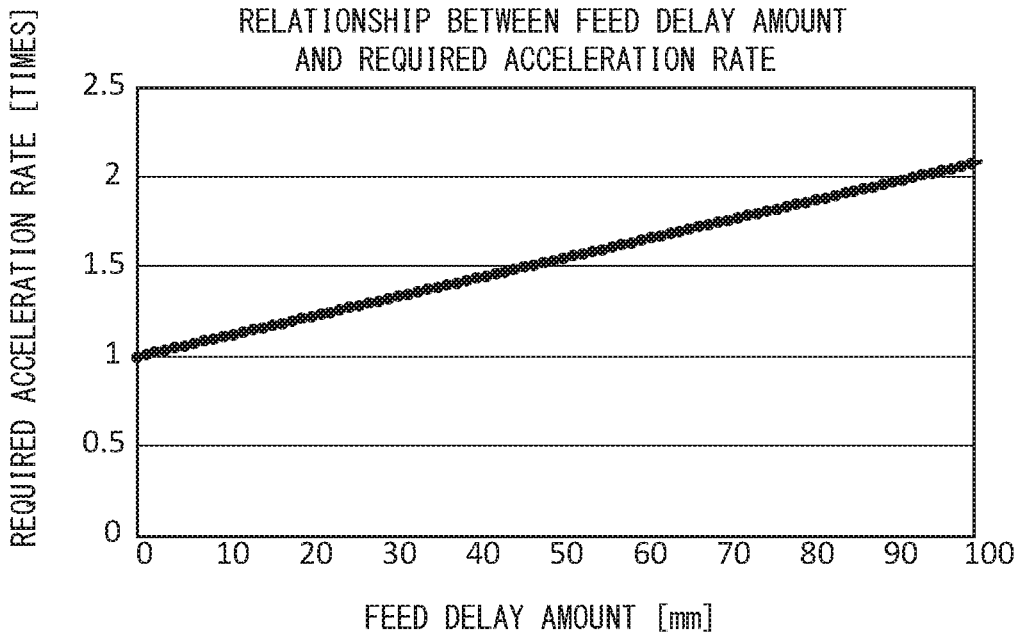
FIG. 10 is a graph showing a relationship between a feed delay amount and a required acceleration rate in a second embodiment.

FIG. 10 is a diagram showing a relationship between the feed delay amount and the acceleration rate required in the acceleration and deceleration control. FIG. 10 shows that, as the feed delay amount increases, the acceleration rate required for reducing the sheet interval to the target value increases. That is, the acceleration rate required for the feed motor is determined depending on the value of the feed delay amount assumed in a case where the feeding of a sheet is most delayed.

FIG. 11 is a table for determining the target value of the sheet interval in the present embodiment. From this table, the target value of the sheet interval when the second and subsequent sheets are conveyed is derived from the feed delay amount when the first sheet in the job is conveyed and the average value PWM_AVE of the PWM duty.

When the load torque applied to the feed motor is constant (that is, when focus is given to the rows of the table), the target value of the sheet interval increases as the feed delay amount when the first sheet is conveyed increases. This is to prevent the required acceleration rate from becoming too large because when the feed delay amount when the first sheet is conveyed is large, relatively large feed delay is expected to occur for the second and subsequent sheets.

In addition, when the feed delay amount when the first sheet is conveyed is constant (that is, when focus is given to the columns of the table), the target value of the sheet interval increases as the load torque applied to the feed motor increases (as the value of PWM_AVE increases). This is to consider that as the load torque applied to the feed motor increases, the acceleration rate that can be realized by the motor in the acceleration and deceleration control is more limited (see FIG. 7).

It is assumed that the content of the table shown in FIG. 11 is stored in a nonvolatile storage area of the memory 27 (FIG. 1) mounted in the image forming apparatus and is referred to by the CPU 26 as appropriate. However, the invention is not limited to the method of calculating the target value of the sheet interval using such a table. For example, a function of calculating the target value of the sheet interval from a variable indicating the magnitude of the load torque and a variable indicating the degree of feed delay may be implemented as a part of a program executed by the CPU 26.

Figure 12:
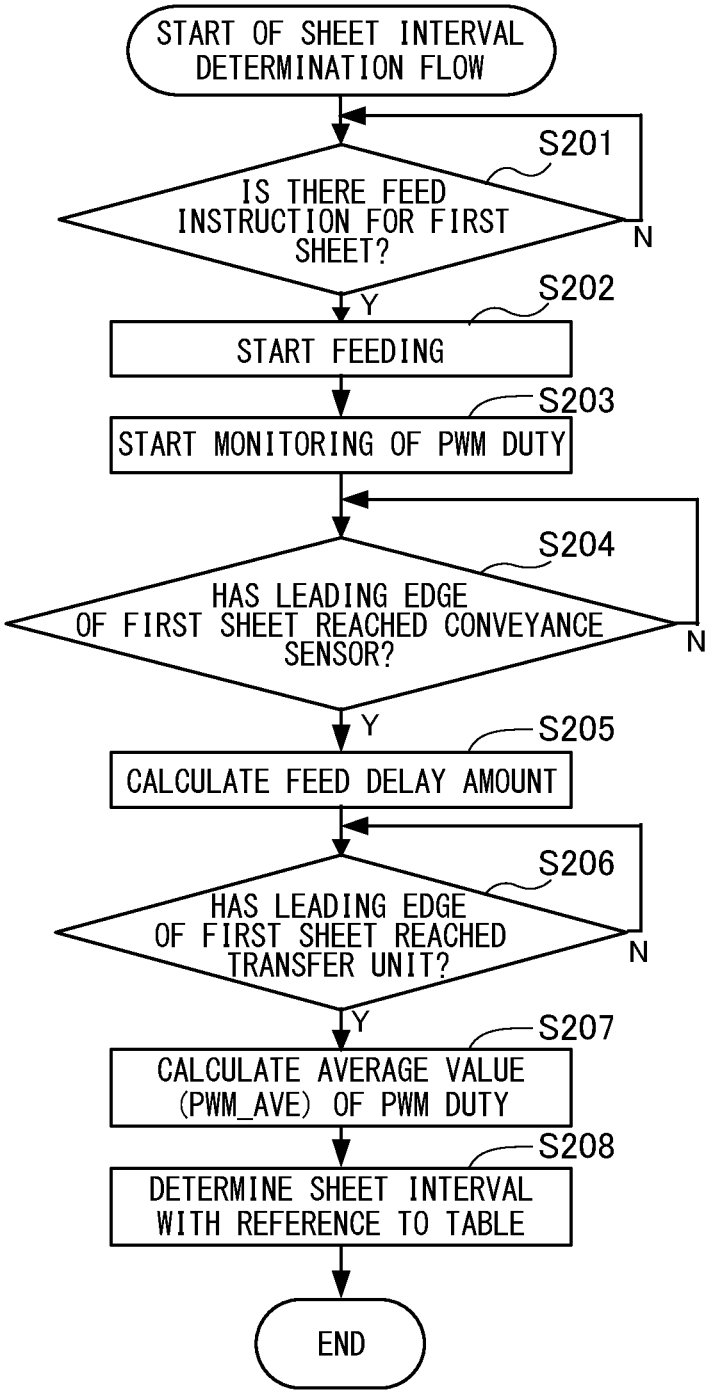
FIG. 12 is a flowchart showing a control method of an image forming apparatus according to the second embodiment.

The control method of the image forming apparatus for realizing the above-described operation will be described with reference to FIG. 12. FIG. 12 is a flowchart of a process for determining the target value of the sheet interval in the present embodiment. It is assumed that each step of this process is performed by reading and executing a control program stored in the memory 27 by the CPU 26 (FIG. 1). In addition, this process is started when the CPU 26 executes an image forming job.

When there is a feed instruction for the first sheet in the job (S201), the CPU 26 causes the feed roller 14 to start feeding the first sheet by rotating the feed motor 34 and engaging the feed clutch 35 (S202). Then, the CPU 26 starts recording the duty cycle (PWM duty) of the PWM signal transmitted to the driver circuit unit 46 of the feed motor 34 (S203).

When the conveyance sensor 15S detects that the leading edge of the first sheet has reached the detection position of the conveyance sensor 15S (S204), the CPU 26 calculates a feed delay amount D (S205). The feed delay amount D is calculated by the following equation using the elapsed time T from the feed start timing in S202 to the detection timing in S204.

$$D=(T-T\mathrm{ref})\times Vpr\times 1.2$$

Here, Tref in the above equation is the value of the elapsed time T when it is assumed that there is no feed delay, and Vpr is the process speed. In addition, the coefficient "1.2" defines a margin in consideration of the variation of the feed delay amount D for each sheet. By setting the coefficient to a value larger than 1, the value of the feed delay amount D in setting the target value of the sheet interval is estimated to be larger than the actual feed delay amount of the first sheet. That is, the coefficient is selected so that, even in a case where the actual feed delay amount of the first sheet is a value smaller than the average of the feed delay amounts observed under the same load torque conditions, the feed delay amount D becomes a value larger than the maximum value of the feed delay amount normally occurring under the conditions. Therefore, it can be expected that the target value of the sheet interval calculated from the table shown in FIG. 11 based on the feed delay amount D can be sufficiently achieved by the acceleration and deceleration control even in a case where the actual feed delay amount varies for each sheet.

After S205, when the leading edge of the sheet reaches the secondary transfer unit (S206), the CPU 26 calculates an average value PWM_AVE of the PWM duty (S207). Then, by referring to the table shown in FIG. 11, a value corresponding to the feed delay amount D calculated in S205 and the average value PWM_AVE of the PWM duty calculated in S207 is determined as a target value of the sheet interval (S208).

As described above, in the present embodiment, the target value of the sheet interval in the acceleration and deceleration control is changed depending not only on the magnitude of the load torque detected by the torque detection unit when the feed motor is rotated but also on the magnitude of the feed delay amount. Therefore, the target value of the sheet interval can be set to a smaller value under the conditions in which the feed delay amount is expected to be relatively small. As a result, it is possible to improve the productivity of the image forming apparatus more than in the first embodiment.

In addition, as described in the modification example of the first embodiment regarding the timing at which the magnitude of the load torque is acquired, the timing at which the magnitude of the feed delay amount is acquired is not limited to the case where the first sheet in the job is conveyed. It is conceivable that the feed delay amount set when the previous job was executed is continuously used in the current job or the average value of the feed delay amount when a plurality of sheets are fed is used.

Other Embodiments

In the first and second embodiments, the configuration has been described in which a sheet fed from the feed cassette 13 is conveyed to the secondary transfer unit without stopping. However, the present technique can also be applied to a configuration in which sheet conveyance is temporarily stopped. For example, there is known a configuration in which a motor for driving the registration roller 16 is provided separately from the feed motor and the driving of the registration roller 16 is started after performing skew correction by bringing the leading edge of the sheet into contact with the registration roller 16 in a stopped state. In this case, alignment between the image and the sheet is performed according to the driving start timing of the registration roller 16. However, as in the first and second embodiments, it is possible to improve the productivity by making the interval at which the sheet reaches the registration roller 16 approach a constant value.

In addition, in the first and second embodiments, the case has been described in which a brushless motor is used as an example of a motor. However, the present technique can also be applied to a case where a synchronous motor (for example, a stepping motor) other than the brushless motor is used. In addition, even in an induction motor in which a slip occurs between the rotating magnetic field and the rotor, the rotational speed or the position can be controlled with relatively high accuracy by using the vector control. Therefore, the present technique may be applied to an image forming apparatus using an induction motor.

In addition, in the first and second embodiments, the case has been described in which the present technique is applied to the operation of the electrophotographic apparatus to convey the sheet toward the image forming position (transfer position). However, by applying the present technique to a sheet conveyance apparatus for performing a conveyance operation to convey a sheet toward a predetermined position, other than the image forming apparatus, it is possible to change the motor control in the conveyance operation based on the detection result of the torque detection unit. As such a sheet conveyance apparatus, for example, an auto document feeder for conveying a sheet serving as a document toward a scanning position where scanning by an image sensor in an image reading apparatus is performed can be mentioned.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-096258, filed May 22, 2019, which is hereby incorporated by reference herein in its entirety.

What is claimed is:

1. An image forming apparatus, comprising:

an image forming unit configured to form an image on a sheet at an image forming position;

a conveyance unit configured to convey a sheet toward the image forming position;

a motor configured to drive the conveyance unit;

a torque detection unit configured to detect a load torque applied to the motor; and a control unit configured to perform a speed control for changing a rotational speed of the motor such that an interval at which a preceding sheet and a succeeding sheet pass through the image forming position approaches a target interval while the conveyance unit is performing a conveyance operation for conveying the succeeding sheet, wherein the control unit executes an interval change processing for changing the target interval in the speed control based on a magnitude of a load torque detected by the torque detection unit when the conveyance unit is driven by the motor, the control unit is configured to be able to control power input to the motor by transmitting a command signal to a driving circuit of the motor, and the torque detection unit detects the command signal.

2. The image forming apparatus according to claim 1, wherein the control unit executes the interval change processing such that the target interval is set to a first interval in a case where the load torque detected by the torque detection unit when the conveyance unit is driven by the motor is a first value, and the target interval is set to a second interval larger than the first interval in a case where the load torque detected by the torque detection unit when the conveyance unit is driven by the motor is a second value larger than the first value.

3. The image forming apparatus according to claim 1, wherein, when executing a job of repeatedly performing the conveyance operation on a plurality of sheets, the control unit determines the target interval for second and subsequent sheets by executing the interval change processing based on the magnitude of the load torque detected by the torque detection unit when performing the conveyance operation on a first sheet.

4. The image forming apparatus according to claim 3, further comprising a sheet detection unit configured to detect a sheet, on a conveyance path, being conveyed toward the image forming position by the conveyance unit, wherein, in the interval change processing, the control unit determines the target interval for the second and subsequent sheets based on the magnitude of the load torque detected by the torque detection unit when performing the conveyance operation on the first sheet and a timing at which the sheet detection unit detects the first sheet.

5. The image forming apparatus according to claim 1, wherein the image forming unit comprises an image bearing member configured to rotate while carrying a toner image, the image forming apparatus further comprises:

a stacking unit on which a sheet conveyed by the conveyance unit is stacked; and a transfer member facing the image bearing member and configured to transfer the toner image carried on the image bearing member to a sheet at the image forming position; and the control unit performs the speed control such that a sheet fed from the stacking unit is conveyed without stopping until the sheet reaches the image forming position, and a timing at which the toner image carried on the image bearing member reaches the image forming position and a timing at which the sheet conveyed by the conveyance unit reaches the image forming position are synchronized with each other.

6. The image forming apparatus according to claim 1, wherein the command signal is a pulse width modulation signal, and the torque detection unit detects a duty cycle of the command signal.

7. The image forming apparatus according to claim 1, wherein the torque detection unit detects a current flowing through the motor.

8. The image forming apparatus according to claim 1, wherein the motor is a brushless motor.

9. An image forming apparatus, comprising:

an image forming unit configured to form an image on a sheet at an image forming position;

a conveyance unit configured to convey a sheet toward the image forming position;

a motor configured to drive the conveyance unit;

a torque detection unit configured to detect a load torque applied to the motor;

a sheet detection unit configured to detect a sheet, on a conveyance path, being conveyed toward the image forming position by the conveyance unit, and a control unit configured to perform a speed control for changing a rotational speed of the motor such that an interval at which a preceding sheet and a succeeding sheet pass through the image forming position approaches a target interval while the conveyance unit is performing a conveyance operation for conveying the succeeding sheet, wherein the control unit executes an interval change processing for changing the target interval in the speed control based on a magnitude of a load torque detected by the torque detection unit when the conveyance unit is driven by the motor, when performing the speed control, the control unit is configured to change a rotational speed of the motor according to a speed profile comprising an acceleration section where the rotational speed of the motor is accelerated from a first speed to a second speed higher than the first speed, and a deceleration section where the rotational speed of the motor is decelerated from the second speed to a third speed lower than the second speed, and the control unit changes a magnitude of the second speed in the speed profile according to a sheet detection timing of the sheet detection unit.

10. An image forming apparatus, comprising:

an image forming unit configured to form an image on a sheet at an image forming position;

a conveyance unit configured to convey a sheet toward the image forming position;

a motor configured to drive the conveyance unit;

a torque detection unit configured to detect a load torque applied to the motor; and a control unit configured to perform a speed control for changing a rotational speed of the motor such that an interval at which a preceding sheet and a succeeding sheet pass through the image forming position approaches a target interval while the conveyance unit is performing a conveyance operation for conveying the succeeding sheet, wherein the control unit executes an interval change processing for changing the target interval in the speed control based on a magnitude of a load torque detected by the torque detection unit when the conveyance unit is driven by the motor, and the control unit executes the interval change processing based on an average value of the load torque detected by the torque detection unit in a period from when the motor drives the conveyance unit to start conveying a sheet to when a leading edge of the sheet reaches the image forming position.

* * * * *